United States Patent [19]

Troebel et al.

[11] 4,260,969

[45] Apr. 7, 1981

[54] LOW VOLTAGE CIRCUIT BREAKER WITH AN ELECTROMAGNETIC TRIPPING DEVICE

[75] Inventors: Werner Troebel; Erwin Klatt, both of Berlin, Fed. Rep. of Germany

[73] Assignee: Siemens Aktiengesellschaft, Berlin and Munich, Fed. Rep. of Germany

[21] Appl. No.: 17,980

[22] Filed: Mar. 6, 1979

[30] Foreign Application Priority Data

Mar. 10, 1978 [DE] Fed. Rep. of Germany ..... 2810987

[51] Int. Cl.[3] ..... H01H 73/48

[52] U.S. Cl. ..... 335/38; 335/36

[58] Field of Search ..... 335/38, 39, 40, 35, 335/36, 37, 174, 23; 337/75

[56] References Cited

U.S. PATENT DOCUMENTS

| | | | |
|---|---|---|---|
| 3,178,535 | 4/1965 | Gelzheiser et al. | 335/36 |
| 3,743,981 | 7/1973 | Geleziunas | 335/23 |
| 3,909,764 | 9/1975 | Belttary | 335/75 |

*Primary Examiner*—Harold Broome

*Attorney, Agent, or Firm*—Kenyon & Kenyon

[57] ABSTRACT

A low voltage circuit breaker has an insulating housing which is split along a parting line into an upper part and a lower part. Disposed in the housing is an electromagnetic tripping device which comprises a fixed magnet yoke and a movably disposed armature. By means of trunnion (pivot) pins of rectangular cross-section the armature is mounted in bearing openings designed in the form of pocket-like cutouts in the wall surfaces of the lower part which limit the pole channels of the circuit breaker. The bearing surface of the bearing openings associated with a narrow surface of each trunnion pin may be composed of two subsurfaces disposed at an angle to each other so that an edge-like bearing results. For the attachment of the magnet yoke there is provided on the lower part of the housing an island-like projection which is spaced from the wall surfaces and against which the central part of the magnet yoke is caused to rest by a spring element. In addition, a protrusion of a conductor serves to secure the magnet yoke in its position.

6 Claims, 7 Drawing Figures

LOW VOLTAGE CIRCUIT BREAKER WITH AN ELECTROMAGNETIC TRIPPING DEVICE

BACKGROUND OF THE INVENTION

This invention relates to circuit breakers in general and more particularly to a low voltage circuit breaker with an insulating housing which is split along a parting line into an upper part and a lower part and in which is disposed an electromagnetic tripping device having a movably mounted armature and fixed magnet yoke.

A circuit breaker of this general kind is described, for example, in U.S. Pat. No. 3,125,651. In the known circuit breaker, the magnet yoke and armature configuration essential for the functioning of the electromagnetic tripping device utilizes a sheet metal frame. This frame is joined to the lower part of the insulating housing of the circuit breaker by means of a screw. The armature is pivoted in slots of the frame while the magnet yoke is fastened to the frame in a form-locking and positively connected manner by bent sheet metal ends.

SUMMARY OF THE INVENTION

It is an object of the present invention to eliminate the frame-like sheet metal part hitherto used for the electromagnetic tripping device.

According to the present invention, this object is achieved by mounting or fastening the armature and the magnet yoke each separately to only the housing of the low voltage circuit breaker. The spatial correlation of magnet yoke and armature is achieved in the present invention by bearing points and fastening points on the housing. Since these bearing points and fastening points can be made out of the same molding compound and at the same time the housing is made, costs are particularly low. Tests have shown that the elimination of the frame-like sheet metal part entails no disadvantage for the operation of the electromagnetic tripping device. In addition to the material savings, the elimination of this part brings with it space savings in the interior of the circuit breaker which can be utilized for a more favorable design of the component parts or for a size reduction of the circuit breaker.

It is already known, in a low voltage circuit breakers of an overall size roughly comparable to those used in automatic house wiring circuit breakers, to mount a pivoted component serving simultaneously as a magnet armature of an electromagnetic tripping device and as a locking bar, in recesses in the walls of a housing of insulating material. But such a design did not involve the problem of, at the same time, arranging the magnet armature at a precisely fixed distance opposite a magnet yoke, because the magnet yoke is formed by an iron part disposed at the free end of a bimetal strip. This arrangement is not usable for low voltage circuit breakers of greater current breaking capacity, which also require greater tripping forces.

Within the scope of the present invention, the armature of the electromagnetic tripping device may engage, by means of laterally projecting trunnion pins, pocket-like bearing openings of the lower housing part which are open towards the parting line, and these bearing openings may be limited by counterparts, in the ready to operate condition of the circuit breaker. In this arrangement, the armature can be assembled with particular ease because at first the cutouts are open towards the top. The counterparts may be formed, for example, by extensions of the upper housing part or by other parts to be assembled after the insertion of the armatures.

The trunnion (pivot) pins may be of rectangular cross-section, and the pocket-like bearing openings may be defined laterally by surfaces disposed at an angle relative to each other. The angle between these surfaces is expediently adapted to the intended or required tilting angle of the armature.

A blade-like bearing support of advantageously low friction resistance is obtainable in that the bearing surface for the armature trunnion pins is composed of two subsurfaces disposed at an angle relative to each other. It is then expedient to make the width of the subsurface half as large as the narrow sides of the trunnion pins.

On the lower housing part an island-like projection of wall surfaces arranged in U-shape may be provided and the magnet yoke may be pushed against this projection by a spring element inserted between its center leg and a wall surface. In this manner the magnet yoke is fastened in a form-locking and positively connected manner to the lower housing part, using particularly few component parts and a little loss of time. In addition, a conductor disposed near the magnet yoke may be provided with a projection which engages over the magnet yoke, thus retaining it in its place.

DETAILED DESCRIPTION OF THE INVENTION

Figure 1:
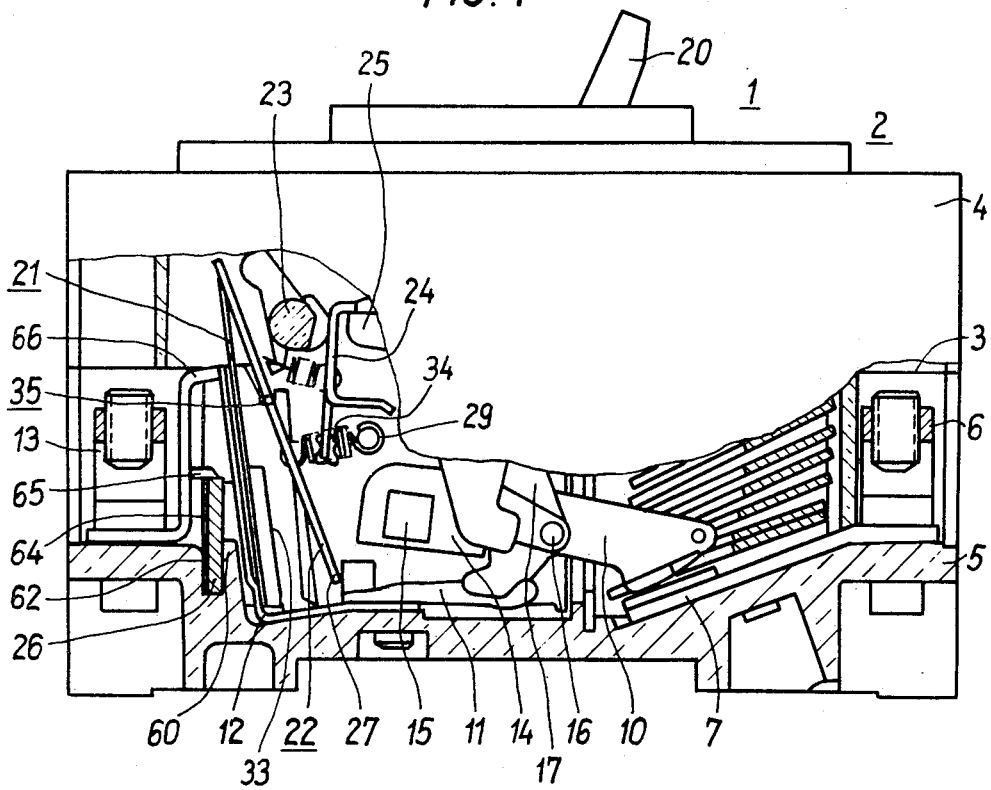
FIG. 1 shows the low voltage circuit breaker in a partially cut-away longitudinal section.

The circuit breaker 1 shown in FIG. 1 has an insulating housing 2 which may be made of a plastic molding compound, for example. The housing 2 is split along a parting seam 3 into an upper part 4 and a lower part 5. Starting from a connecting device 6, the current path of the circuit breaker 1 runs via a fixed contact 7 and a movable contact 10 and via a flexible conductor 11 and a heating element 12 to another connecting device 13. The moving contact 10 is hinged to a contact carrier 14 which is connected by a switching shaft 15 to the contact carriers of the adjacent poles, of the circuit breaker 1, not visible in FIG. 1. A joint pin 6 is acted upon by the one lever 17 of a toggle system which is movable by an operating handle 20 projecting out of an opening of the upper part 4 in known manner and, therefore, not detailed.

In addition to the operating handle 20, the moving contact 10 is also transferable from the "on" position shown to the "off" position by a thermal tripping device 21 and an electromagnetic tripping device 22. The two tripping devices jointly influence the angular position of a tripping shaft 23 which, in turn, interacts with a locking bar 24. A pawl 25 of the latch of the circuit breaker 1 can be locked by means of this locking bar.

Figure 5:
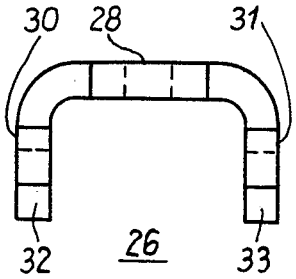
FIG. 5 is a top view of a magnet yoke.
Figure 6:
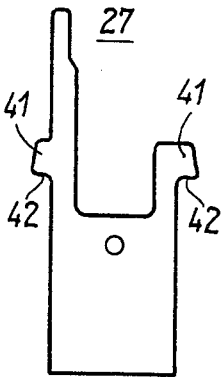
FIG. 6 illustrates the associated armature.

The magnetic tripping device 22 comprises a fixed magnet yoke 26 and a pivoted armature 27 (FIG. 6). A tension spring 29 keeps the armature 27 in its normal position shown. The heating element 12 extends between the legs 30 and 31 of the magnet yoke 26 (FIG. 5). Accordingly, the magnet yoke is energized by the current flowing through the current path of the circuit breaker. If this current is sufficiently large, for instance, in the event of a short circuit, the armature 27 is pulled against the inclined pole surfaces 32 and 33 of the magnet yoke 26, against the force of the return spring 29, and is thereby tilted so that the tripping shaft 23 is turned clockwise and the locking bar 24 is tilted counterclockwise about its pivot bearing 34. The moving contact 10 is then transferred into its off position under the influence of stored spring forces.

Figure 2:
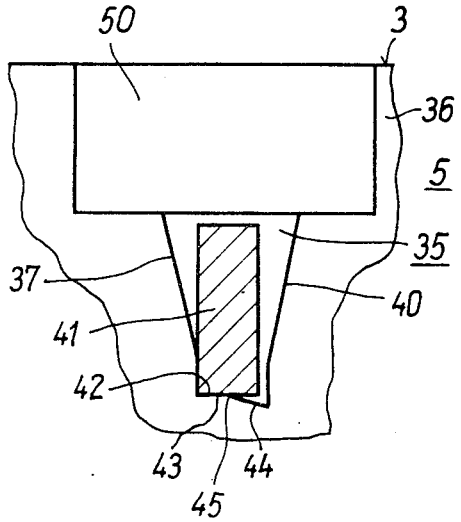
FIG. 2 is a section of the sidewall of a lower housing part of the circuit breaker shown in FIG. 1.

The bearing opening of the armature 27, designated 35 in FIG. 1, is shown on a larger scale in FIG. 2. It can be seen that the bearing opening 35 is designed as a pocket-like cutout in a sidewall or partition 36 of the lower part 5 of the housing 2 and is open on top towards the parting line 3. Laterally the bearing opening is defined by surfaces 37 and 40 standing at an angle to each other and permitting the armature 27 to tilt to a desired or required angle. About half of the lower, narrow surface 42 of the trunnion pin 41 of the armature 27, shown shaded in FIG. 2, rests on a subsurface 43 angularly adjacent to another subsurface 44 of approximately the same length. The subsurfaces 43 and 44, meeting at 45, therefore, form a roughly knife-edge-like bearing surface for the trunnion pin 41.

In place of the subsurfaces 43 and 44 disposed at an angle to each other, a single surface may also be provided. The rotary motion is then performed on an edge of the trunnion pin 41.

Towards the top, the bearing opening 35 expands into a rectangular cutout 50, provided to accommodate a counterpart attached to the upper part 4 of the housing 2.

Figure 3:
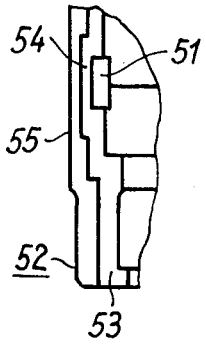
FIGS. 3 and 4 are corresponding sections of the upper housing part in two different views.
Figure 4:
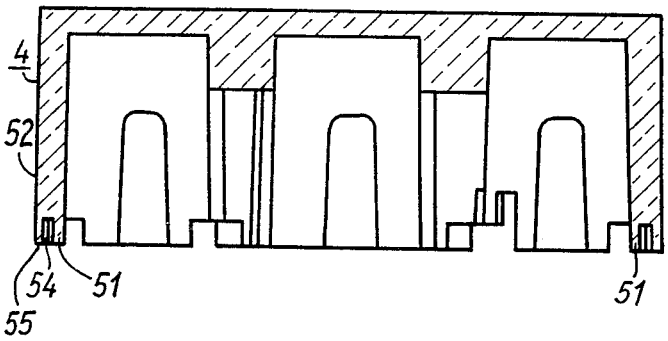

Such a counterpart 51 is recognizable in FIG. 3 which shows a section of the sidewall 52 of the upper part 4 of housing 2 as viewed in the direction towards the parting line 3. The counterpart 51 forms a projection from the lower part 53 of a stepped sidewall 52 so that a space 54 remains between it and the higher part 55 of the sidewall 52. For a better illustration of this arrangement reference is made to FIG. 4, which shows the sidewall 52 in a cross-section.

Identical bearing openings 35 are disposed in each wall of the lower part 5 of housing 2 which define a pole channel of the circuit breaker 1 (FIG. 2). Therefore, the armatures assigned to each pole channel are mounted in the bearing openings 35 by means of two trunnion pins 41 each, determining a bearing axis. When assembling the circuit breaker 1, the armature trunnion pins are inserted into the bearing openings 35 from above. By assembling the upper part 4 of housing 2, the bearing openings in the outside walls are closed. The other bearing openings are closed in a similar manner by counterparts of other components of the circuit breaker 1 which are assembled after the armature 27.

Figure 7:
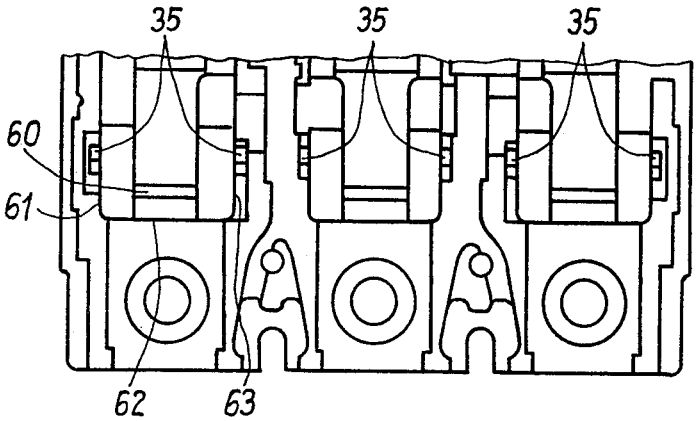
FIG. 7 shows a portion of the lower part of the circuit breaker housing.

An island-like projection 60 is provided in each pole path of the circuit breaker 1 to fasten the magnet yoke 26 to the lower part 5 of housing 2. As is evident particularly from FIG. 7, which shows a top view of the portion of the lower part 5 of housing 2 depicted on the left in FIG. 1, the projections 60 are disposed so as to be spaced from the wall surfaces 61, 62, and 63 arranged in U-shape. This U-shaped space fits the shape of the magnet yoke 26 (FIG. 5) so that the central part 28 of the magnet yoke 26 can be accommodated between the projection 60 and the central wall surface 62. The dimensional design of the components creates a space for inserting a spring element 64 which causes the central part 28 of the magnet yoke 26 to rest against the projection 60. In its position shown in FIG. 1, the magnet yoke 26 is additionally retained by a projection 65 of a conductor 66 which establishes the connection of the connecting device 13 to the heating element 12. Consequently, the magnet yoke 26 is retained merely by form-closing, positive means without screws, rivets or similar elements.

What is claimed:

1. In a low voltage circuit breaker with an insulating housing split along a parting line into an upper part and lower part, with an electromagnetic tripping device having a movably mounted armature, and a fixed magnet yoke disposed in said housing, the improvement comprising:

(a) said armature supported for rotation by laterally projecting trunnion pins; and (b) means in said housing for separately mounting the armature and magnet yoke to the housing only including:

(i) pocket-like bearing openings formed in the lower part of the housing which openings are opened toward the parting line, and (ii) counterparts in the upper housing parts confining the bearing openings in the ready to operate condition of the circuit breaker.

2. The improvement according to claim 1, wherein said trunnion pins are of rectangular cross-section and said pocket-like bearing openings are defined laterally by surfaces disposed at an angle relative to each other.

3. The improvement according to claim 1, wherein the bearing surface for the trunnion pins in the pocket-like bearing opening comprises two subsurfaces disposed at an angle to each other.

4. The improvement according to claim 1, wherein said magnet yoke includes a central leg and said means include an island-like projection in the lower part of the housing spaced from wall surfaces thereof arranged in U-shape and wherein said magnet yoke is disposed therein and further including a spring element biasing said yoke so as to rest against said projection said spring inserted between the central leg of said yoke and an associated wall surface.

5. The improvement according to claim 4, and further including a conductor disposed near the magnet yoke having a projection engaging over said magnet yoke.

6. The improvement according to claim 4, wherein said armature is supported for rotation by laterally projecting trunnion pins and said means include pocket-like bearing openings formed in the lower part of the housing which openings are open towards the parting line, and counterparts in the upper housing parts confining the bearing openings in the ready-to-operate condition of the circuit breaker.

* * * * *